United States Patent [19]

Weikert

[11] 4,286,733

[45] Sep. 1, 1981

[54] APPARATUS FOR CONTROLLING FLOW OF FLUENT MATERIAL

[76] Inventor: Roy J. Weikert, 2000 Schlater Dr., Sidney, Ohio 45365

[21] Appl. No.: 119,053

[22] Filed: Feb. 6, 1980

[51] Int. Cl.[3] ..... B65D 35/56

[52] U.S. Cl. ..... 222/105; 251/7; 222/505; 222/511; 222/528

[58] Field of Search ..... 222/105, 505, 506, 511, 222/512, 515, 528, 529, 531, 532, 537, 542, 544, 559; 251/7, 8

[56] References Cited

U.S. PATENT DOCUMENTS

| | | | |
|---|---|---|---|
| 3,733,046 | 5/1973 | Press | 251/8 |
| 3,811,649 | 5/1974 | Press et al. | 251/8 |
| 3,945,534 | 3/1976 | Ady | 222/105 |

FOREIGN PATENT DOCUMENTS

| | | | |
|---|---|---|---|
| 1367605 | 6/1964 | France | 222/505 |

*Primary Examiner*—H. Grant Skaggs
*Attorney, Agent, or Firm*—Biebel, French & Nauman

[57] ABSTRACT

A valve for controlling gravity flow of a fluent product such as milk from a flexible bag of the product through an opening in the bag formed by severing a corner off the bag. The valve includes a pair of spring loaded jaws which engage the bag on opposite sides just above the opening formed by the removal of the corner. Cooperating cam surfaces on the jaws and on movable frames cause the jaws to move toward and away from each other as the frames are moved with respect to each other. Movement of the jaws away from each other causes the edges of the bag at the opening to become taut and restrict flow through the opening, while movement of the jaws towards each other relaxes the bag material adjacent the opening to enhance flow through the opening. The frames also carry resilient sealing bars which engage opposite sides of the bag just above the opening and seal the opening when the jaws are moved away from each other.

11 Claims, 6 Drawing Figures

APPARATUS FOR CONTROLLING FLOW OF FLUENT MATERIAL

BACKGROUND OF THE INVENTION

Packaging of fluent products, such as milk, catsup and other products, particularly in bulk quantities, is enhanced through the use of pouches or bags of polyethylene, polypropylene and other synthetic resinous materials, either alone or in combination with laminates of a variety of other materials such as paper, foil or the like.

In one commercially successful application, milk products are packaged in large polyethylene bags to which a rubber hose is connected, and the bag is installed in a dispenser with the hose projecting from the dispenser. A handle is provided on the dispenser for controlling the flow of the product from the bag through the hose.

While this approach has proven very successful it will be appreciated that the attachment of the hoses to the bags can be a complicated procedure which necessarily adds to the cost of the product. In this regard, see U.S. Pat. No. 3,812,572, issued May 28, 1974, which is directed to a method and apparatus for attaching a dispensing tube to a pouch or bag of film.

Additionally, particularly when dealing with food products, it is necessary that a dispenser and its parts be readily adapted for cleaning and sterilizing to rigid sanitary standards.

SUMMARY OF THE INVENTION

The present invention provides apparatus for dispensing a fluent product from a bag of the product through an opening formed in the bag without the necessity of a special attachment on the bag, and with the apparatus readily susceptible to necessary sanitizing processes. Additionally, the sterility of the product is maintained during use because there is no contact between the product and parts of the valve.

Specifically, the present invention includes a valve having opposed pairs of gripping jaws adapted to engage a bag adjacent a lowermost corner of the bag on opposite sides thereof and a camming system which allows the jaws to move towards and away from each other to alternately relax and render taut the material adjacent an opening formed by cutting off the lowermost corner of the bag to permit and restrict the flow of a product through the opening.

Movement of the jaws is caused by cooperating cam surfaces on the jaws and on movable frames, so that movement of the frames away from each other allows springs interconnecting the opposed jaws to move the jaws towards each other, relaxing the material of the bag adjacent the opening and permitting the fluent product to flow from the bag.

Cooperating with the jaws are resilient sealing bars carried by the frames. The bars may be made of rubber, resilient plastic or other elastomer. The bars are situated such that when the frames are moved towards each other, which also causes the jaws to move apart and render taut the material along the edge of the cut, the bars engage the bag just above the opening and seal the opening against flow.

Movement of the frames with respect to each other is controlled by a lever which is pivotally attached to a stem projecting from one of the frames. The lever carries a cam which cooperates with a portion of the valve casing so that pivoting the lever causes the frames to move with respect to each other.

Additionally, each of the jaws of the pair is provided with sets of pins received within cam openings formed in handles which control opening and closing of the gripping jaws.

DESCRIPTION OF THE PREFERRED EMBODIMENTS

Figure 1:
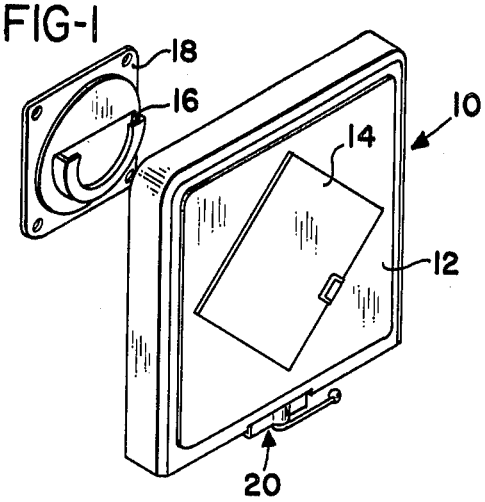
FIG. 1 is an exploded perspective view of a dispenser and wall mounted bracket.
Figure 2:
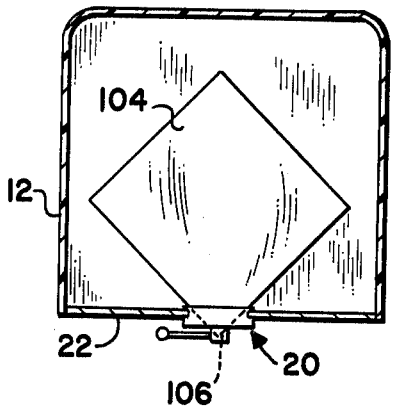
FIG. 2 is a view, partly in cross-section, showing a bag received within the dispenser.

FIG. 1 shows a dispenser 10 including housing 12 having a door 14 for access to the interior thereof, with the housing having an attachment (not shown) on a rear surface thereof adapted to engage in the semi-circular socket 16 of a bracket 18, which can be mounted on a wall or other suitable supporting surface. As shown in FIGS. 1 and 2, the valve 20 of the present invention is received in a slotted opening formed in a lower wall 22 of the housing 12.

While the dispenser 10 is shown with the valve 20 received in the lower wall 22, it will be apparent that the valve could also be mounted at a corner of the dispenser to permit a larger bag to be received in a dispenser of the same size.

Figure 3:
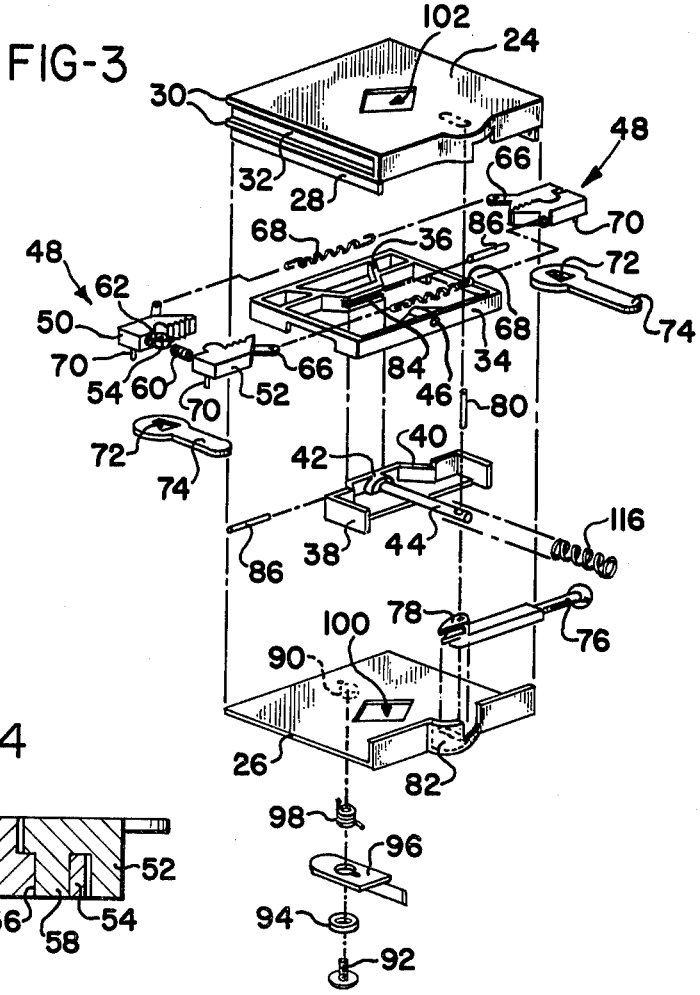
FIG. 3 is an exploded perspective view of the valve of the present invention.

With reference to FIG. 3 of the drawings it will be seen that the valve 20 includes a casing comprising a top section 24 and a bottom section 26, with the top section having a depending flange 28, which defines the side wall of the casing, and a pair of outwardly projecting flanges 30 on each flange 28 which define grooves 32 to receive the edges of the slot formed in the bottom wall 22 of the housing 12. The upper and lower sections 24 and 26 can be secured together by bolts, screws or any suitable fastening means.

Received within the casing is an outer frame 34 having a trapezoidally shaped inwardly projecting portion 36. Received within the outer frame 34 is an inner frame 38, which also has a trapezoidally shaped inwardly projecting portion 40. Threadably received in a boss 42 is an outwardly projecting stem 44 which is slidably received in an opening 46 in the outer frame 34.

Figure 4:
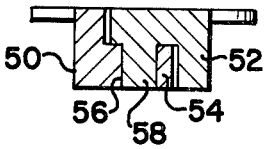
FIG. 4 is a view taken on line 4—4 of FIG. 5.
Figure 5:
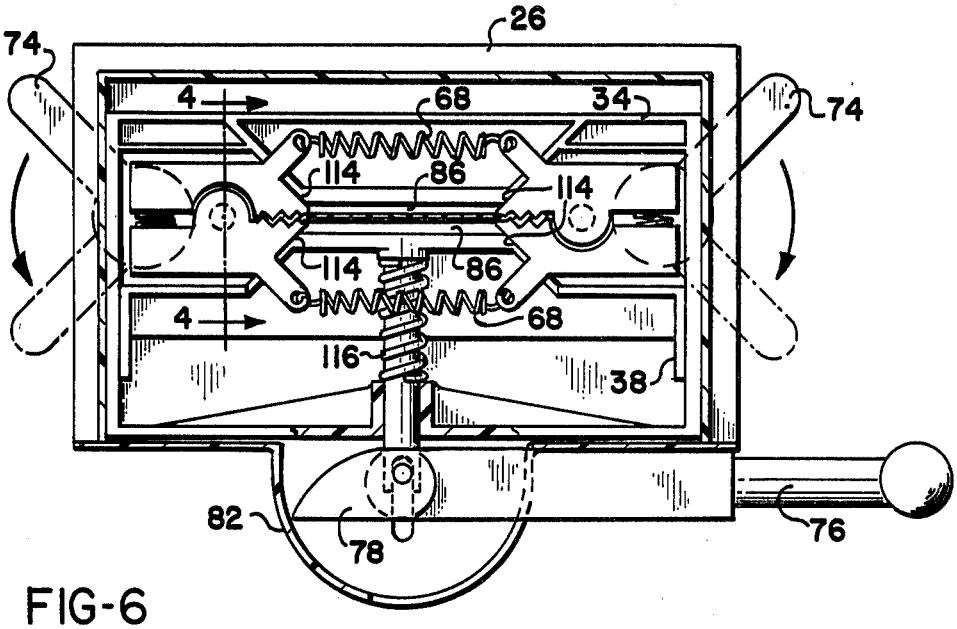
FIG. 5 is a plan view of the valve with its upper wall removed and the valve in the closed position.
Figure 6:
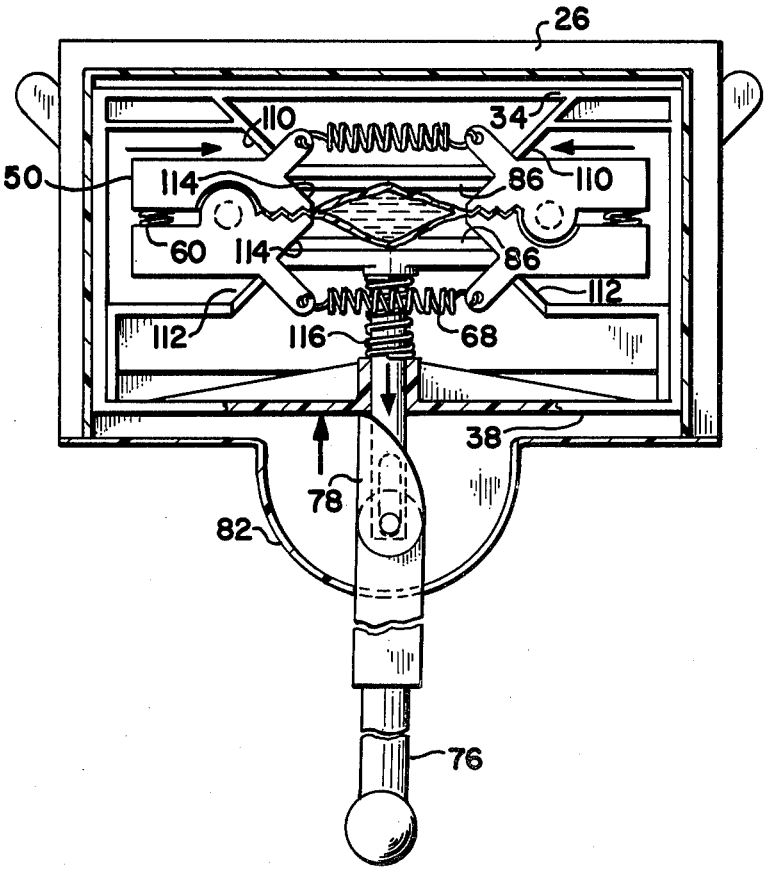
FIG. 6 is a view similar to FIG. 5 but showing the valve in the open position.

As can also be seen in FIGS. 5 and 6 of the drawings, pairs of opposed gripping jaws 48, each including cooperating sections 50 and 52, are also received in the valve casing. Sections 50 have a boss 54, which, as seen in FIG. 4 of the drawings, include a socket 56 to receive a pintel 58 formed integrally with the section 52 to provide a pivot point for the jaws.

Springs 60 are received between rear portion of the sections 50 and 52 in sockets 62 and urge the serrated portions 64 of the jaws toward each other. Lever arms 66 project outwardly from each of the section 50 and 52 and provide anchors for interconnecting coil springs 68. Pins 70 project downwardly from each of the sections 50 and 52 and are received in cam openings 72 formed in handles 74.

A lever 76 having a cam 78 at one end is pivotally attached by means of a pin 80 to an outer end of the stem 44. The lower portion of the valve casing 26 has an enlarged, slotted section 82 for receiving the lever 76 and its associated cam 78. Thus, when lever 76 is pivoted from the position shown in FIG. 6 of the drawings to that shown in FIG. 5, the frames 34 and 38 move within the casing, drawing portions 36 and 40 closer together and causing the jaws 48 to move apart. Conversely, when the frames 34 and 38 are moved in the opposite direction, as seen in FIG. 5, the jaws 48 are drawn towards each other by the springs 68.

It will also be noted from FIG. 3 that the inwardly projecting portions 36 and 40 of frames 34 and 38 are provided with slots, one of which is shown at 84 on member 36, and these slots receive sealing bars 86, also shown in FIGS. 5 and 6, which function in a manner presently to be described.

The lower casing section 26 is provided with an internally threaded boss 90 which receives a bolt 92, which in turn passes through a washer 94, a knife member 96 and a spring 98 and pivotally mounts the knife 96 on the undersurface of the lower section 26 in a position such that when the knife 96 is pivoted it passes past an opening 100 formed in the lower section 26 in alignment with a similar opening 102 formed in the upper section 24.

As seen in FIG. 2 of the drawings, a bag 104 is received in the casing 12 with a lower corner 106 projecting through the aligned openings 102 and 100. The jaws 48 are pivoted to an open position by means of the handles 74 so that they may engage and grip opposed portions of the bag 104 defined by its converging edges just above the lower corner 106. When the jaws have been properly engaged with the bag and are spaced from each other as seen in FIG. 5 of the drawings, the knife 96 can be pivoted past the opening 100 to sever the lower corner 106 from the bag and provide an opening through which a fluent product may be dispensed by gravity.

In the position shown in FIG. 5 of the drawings, the portion 40 of inner frame 38 is positioned adjacent the portion 36 of outer frame 34, with the sealing bars 86 engaging and sealing the bag along its edges just above the cut formed by severing the corner 106. Thus the action of the jaws pulling taut the edges of the bag adjacent the cut and the pressing action of the bars 86 effectively seals the opening of the bag against flow of the product.

When it is desired to dispense material from the bag 104 the handle 76 is pivoted from the position shown in FIG. 5 of the drawings to that shown in FIG. 6. It will be noted that the outer frame 34 carries first camming surfaces 110 which are sloped at an angle of approximately 45° and form an included angle of approximately 90° with the sloped camming surfaces 112 on the inner frame member 38. Third cam surfaces 114 are formed on the jaws 48, complementary to and in engagement with the camming surfaces 110 and 112.

As a result, when the frames 34 and 38 are moved by pivoting the handle 76 the springs 68 urge the jaws 48 to slide inwardly along the cam surfaces 110 and 112 on a substantially straight line toward each other. This relaxes the material of the bag along the edges of the opening, which progresses in configuration from a closed slit, as seen in FIG. 5, toward a more or less rectangular opening. Of course, the relative movement of the two frames with respect to each other also releases the sealing bars 86 from their engagement with the opposite sides of the bag.

When the desired quantity of the product has been allowed to pass from the opening in the bag, the handle 76 is once again pivoted from its FIG. 6 position to the position shown in FIG. 5, camming the jaws 48 outwardly away from each other to their position of maximum spacing shown in FIG. 5 to draw the edges of the cut material taut, while at the same time the resilient sealing bars 86 are brought into sealing engagement with opposite sides of the bag to seal it against further product flow. It will also be noted that stem 44 is provided with a coil spring 116 which tends to maintain the valve in the closed, sealing position shown in FIG. 5 of the drawings.

Additionally, during normal usage lever 76 will not be moved to an over-center position, but will be positioned somewhere between the positions shown in FIGS. 5 and 6, and spring 116 is of sufficient strength to overcome the resistance of the springs 68 and frictional forces between the camming surfaces and automatically close the valve when lever 76 is released.

From the above it will be seen that the present invention provides an improved apparatus for dispensing a fluent product from a flexible bag without special bag attachments and while maintaining sterility of the product during dispensing, and with a construction which facilitates cleaning and sanitation of the valve assembly.

While the form of apparatus herein described constitutes a preferred embodiment of the invention, it is to be understood that the invention is not limited to this precise form of apparatus, and that changes may be made therein without departing from the scope of the invention.

What is claimed is:

1. Apparatus for controlling gravity flow of a fluent product through an opening in a bag containing said fluent product comprising:

means for gripping opposed portions of a bag adjacent an opening therein, means for causing relative movement of said gripping means toward and away from each other including means for separating said gripping means away from each other to a position of maximum spacing wherein edges of a bag adjacent an opening therein are taut to restrict flow therethrough, means, distinct from said separating means, for urging said gripping means toward each other to a position of relatively closer spacing wherein the edges of the bag adjacent the opening are relaxed to enhance flow therethrough, and sealing means operating in conjunction with said gripping means for engaging a bag adjacent an opening therethrough when said gripping means are in said position of maximum spacing to seal against flow through the opening.

2. The apparatus of claim 1 wherein:

said gripping means comprise opposed pairs of pivotally mounted jaws.

3. The apparatus of claim 2 wherein said means for urging said gripping means comprises spring means and said apparatus further includes handles for opening said jaws.

4. The apparatus of claim 1 wherein said means for causing relative movement of said gripping means comprises:

means for moving said gripping means toward and away from each other along a substantially straight line.

5. The apparatus of claim 4 wherein:

said means for causing said relative movement of said gripping means comprises cam means.

6. The apparatus of claim 1 wherein said sealing means comprises:

opposed resilient sealing members mounted for movement toward and away from each other in a direction substantially normal to the direction of movement of said gripping means.

7. The apparatus of claim 1 wherein said means for causing relative movement of said gripping means comprises:

a first frame having first camming surfaces, a second frame having second camming surfaces, complementary third camming surfaces on each of said gripping means in sliding engagement with said first and second camming surfaces, and means for moving said frames relative to each other with said second and first camming surfaces, respectively, moving toward and away from each other.

8. The apparatus of claim 7 further comprising:

a resilient means urging said third camming surfaces thereof into engagement with said first and second camming surfaces.

9. The apparatus of claim 7 wherein said means for moving said frames comprises:

a stem projecting from one of said frames, a lever pivotally attached to an outer end of said stem, and cam means fixed with respect to said lever for causing said lever and said stem to move toward and away from the other of said frames upon pivoting of said lever with respect to said stem.

10. The apparatus of claim 9 further comprising:

spring means encircling said stem and urging said sealing means towards each other.

11. Apparatus for controlling gravity flow of a fluent product from a flexible bag thereof comprising:

an enclosure for holding a flexible bag of fluent material in an upright position to allow said fluent material to settle toward a corner of said bag, pairs of opposed jaws for gripping opposed converging edges of said bag adjacent but above said corner thereof, said pairs of jaws being movable along a straight line between a first position of maximum spacing from each other and positions relatively closer together, means urging said opposed pairs of jaws toward each other, means resiliently urging jaws of each pair thereof into gripping engagement with said opposed edges of said bag, handle means for moving said jaws of each pair thereof out of said gripping engagement, an outer frame receiving said pair of jaws for sliding movement toward and away from each other, first camming surfaces carried by said outer frame in complementary engagement with camming surfaces on said pairs of jaws, an inner frame received within said outer frame and movable with respect thereto, second camming surfaces carried by said inner frame in complementary engagement with camming surfaces on said pairs of jaws, adjacent first and second camming surfaces defining an included angle of ninety degrees, opposing resilient sealing bars carried by said inner and outer frames and adapted to engage said bag intermediate said pairs of jaws when said pairs of jaws are in said first position, said first and second camming surfaces on said inner and outer frames and said camming surfaces on said pairs of opposed jaws being disposed with respect to each other such that movement of said frames with respect to each other along a line perpendicular to said line of movement of said opposed pairs of jaws results in said movement of said opposed pairs of jaws, lever means for moving said frames toward and away from each other, and spring means urging said sealing bars into engagement with said bag.

* * * * *